US005797161A

United States Patent [19]

Campbell

[11] Patent Number: 5,797,161

[45] Date of Patent: Aug. 25, 1998

[54] NOZZLE FOR A FLUID VACUUM CLEANING SYSTEM

[75] Inventor: Joanne Marie Campbell, Klamath Falls, Oreg.

[73] Assignee: Production Metal Forming, Inc., Klamath Falls, Oreg.

[21] Appl. No.: 273,637

[22] Filed: Jul. 12, 1994

[51] Int. Cl.[6] ..... A47L 11/38

[52] U.S. Cl. ..... 15/322; 15/421

[58] Field of Search ..... 15/321, 322, 421

[56] References Cited

U.S. PATENT DOCUMENTS

| | | | |
|---|---|---|---|
| 2,275,357 | 3/1942 | Gaines | 15/421 X |
| 3,230,569 | 1/1966 | Nielsen | 15/421 X |
| 3,550,183 | 12/1970 | Wolf | 15/421 X |
| 3,840,935 | 10/1974 | Fitzgerald et al. | 15/322 |
| 4,161,802 | 7/1979 | Knight et al. | 15/322 X |
| 4,263,693 | 4/1981 | Mekelburg | 15/421 X |

FOREIGN PATENT DOCUMENTS

| | | | |
|---|---|---|---|
| 2704308 | 8/1978 | Germany | 15/322 |

*Primary Examiner*—Chris K. Moore
*Attorney, Agent, or Firm*—Dority & Manning, P.A.

[57] ABSTRACT

A nozzle for a fluid vacuum cleaning system for simultaneously applying a cleaning fluid and a vacuum force to a surface is provided. The nozzle includes a hollow, rigid wand attached to a suction chamber and a cleaning fluid dispenser head. The suction chamber consists of a front plate and a rear plate which are connected together by a top plate and a pair of opposing side plates. The suction chamber has an open free end in the shape of a narrow slit and further includes at least one aperture positioned on the rear plate. As the cleaning fluid dispenser head sprays a fluid on a surface, the suction chamber removes moisture and dirt from the material being cleaned. The apertures on the rear plate serve to draw in any excess liquid that has accumulated on the surface.

25 Claims, 4 Drawing Sheets

10
12
18
14
16
20

38
22
20
16
36
34
32
32'
42
40
28
24
42'
26

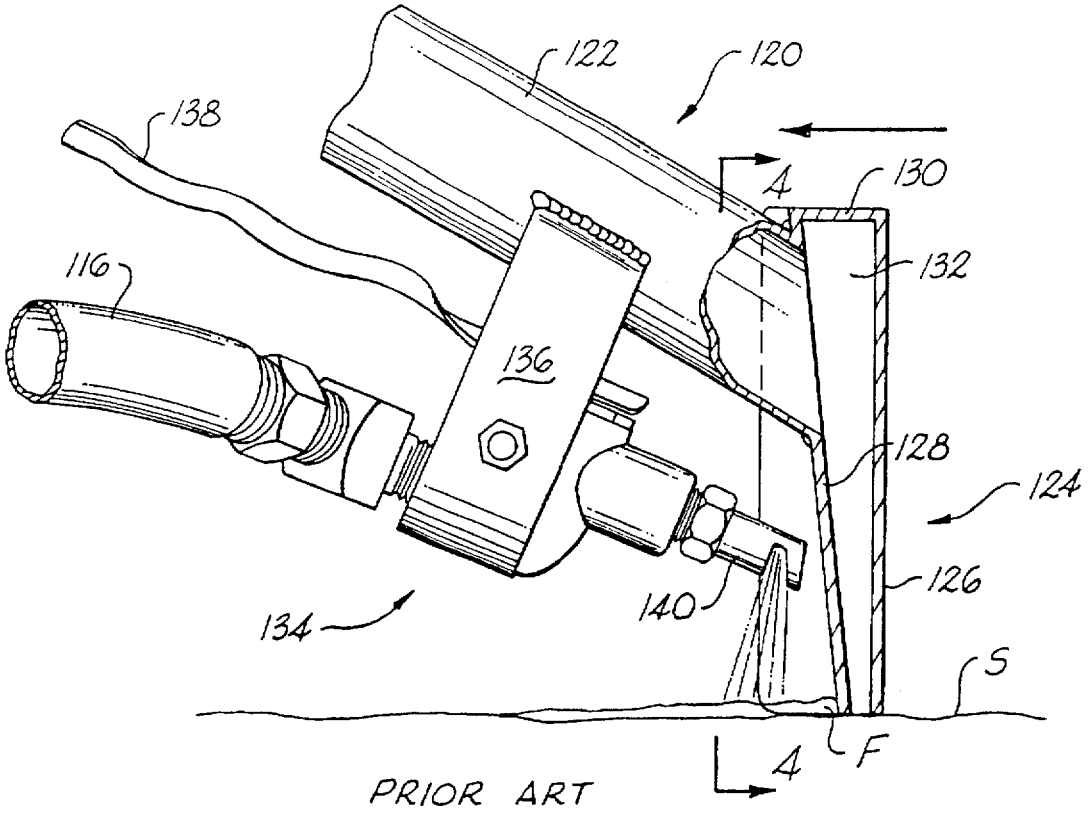
PRIOR ART
Fig. 3
PRIOR ART
Fig. 4
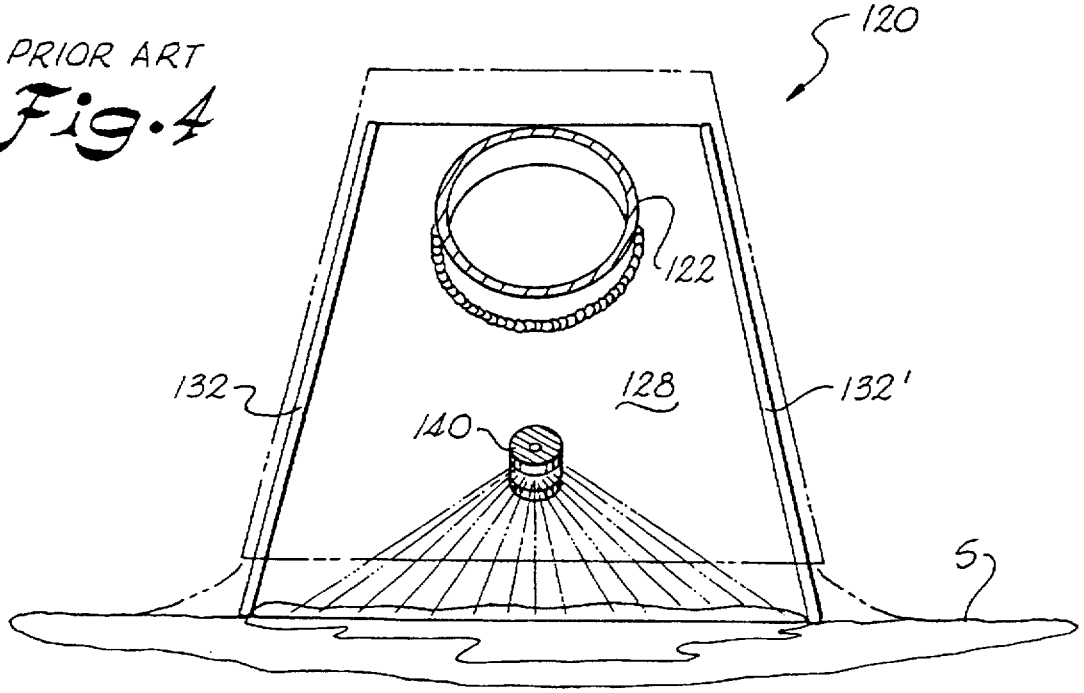

NOZZLE FOR A FLUID VACUUM CLEANING SYSTEM

BACKGROUND OF THE INVENTION

This invention relates generally to a fluid vacuum cleaning system of the type particularly adapted for cleaning the surfaces of upholstery, carpet and the like. More particularly, the invention relates to a nozzle for a fluid vacuum cleaning system.

Fluid vacuum cleaning systems have been used regularly for cleaning carpeting, draperies and furniture upholstery. Typical systems include a vacuum cleaner, a cleaning fluid sprayer, a vacuum hose pipe and a nozzle. The nozzle serves to simultaneously spray the cleaning fluid and apply a vacuum to the surface being cleaned. The cleaning detergent dissolves and dislodges greases, stains, dirt and other particles while the vacuum removes them from the material.

In the past, nozzles for fluid vacuum cleaners have included a tubular wand leading into a hollow suction head. Attached to the wand was a detergent dispenser which sprayed a cleaning fluid mixture on the surface. The hollow suction head consisted of a pair of spaced-apart plates, trapezoidal in shape. The plates were enclosed at the top and at the sides leaving an open end for application of a vacuum force to a surface. Typically, the plates were spaced relatively close together and flared out at the open end forming a long, narrow slit. Consequently, the suction force of the vacuum was concentrated along this narrow slit.

During cleaning, the detergent dispenser would apply the cleaning fluid mixture while the suction head would vacuum up the fluid in a back-and-forth motion. During this process, the bottom edges of the plates surrounding the narrow slit would form a seal between the suction head and the surface being cleaned. Once a seal is formed, the suction head could still remove moisture and dirt from the material. However, formation of the seal prevented the suction chamber from removing any excess liquid on the surface. Instead of picking up the excess liquid, the suction head performed more like a squeegee in pushing or spreading the liquid elsewhere. In order to vacuum up any excess fluid, the suction head seal had to be broken by physically lifting the suction head from the surface and placing it in the pool or puddle of excess liquid. However, when the suction head was lifted, the material being cleaned tended to get caught in the open end of the head due to a combination of the lifting movement and the suction force. Some materials, especially napped fabrics became creased or marked when this occurred. Also, periodic lifting of the nozzle off the surface led to sporadic and non-uniform cleaning.

Since it would be very difficult to control the dispensation of the cleaning fluid to avoid puddling or pooling in all situations and applications, attempts have been made to modify the suction chamber in order to remove excess liquid without having to lift the vacuum nozzle off the surface. One attempt to solve this problem included putting notches in the edges of the suction head forming the open end. Unfortunately, the suction force of the vacuum cleaner can pull the material into the notches. Again, the material can become marked or creased.

Therefore, a need exists for a nozzle for a fluid vacuum cleaning system. More specifically, a need exists for a nozzle that will pick up excess fluid on a surface without having to lift the nozzle off the surface and without creasing or marking the material being cleaned.

SUMMARY OF THE INVENTION

The present invention recognizes and addresses various of the foregoing drawbacks, and others, concerning nozzles for fluid vacuum cleaning systems. Thus, broadly speaking, one main object of this invention is to provide an improved nozzle for a fluid vacuum cleaner.

It is another principal object of the present invention to provide a nozzle for a fluid vacuum cleaning system which is capable of removing pools and puddles of excess liquid without being lifted from the surface being cleaned.

It is another object of the present invention to provide a nozzle for a fluid vacuum cleaning system for uniformly cleaning surfaces of carpet, upholstery or the like and for drawing off excess pools of liquid without creasing or marking the material being cleaned.

It is a further object of the present invention to provide a fluid vacuum cleaner for cleaning the surfaces of upholstery, carpets and the like with a cleaning fluid wherein pools of excess cleaning fluid are efficiently lifted from the treated surface without disrupting the contact between the cleaning edges of the nozzle and the treated surface.

Additional objects and advantages of the invention are set forth in or will be apparent to those of ordinary skill in the art from the detailed description which follows. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like. Still further, it is to be understood that different embodiments, as well as different presently preferred embodiments, of this invention may include various combinations or configurations of presently disclosed features or elements, or their equivalents (including combinations or configurations thereof not expressly shown in the figures or stated in the detailed description. One such exemplary embodiment of the present invention relates to a nozzle for a fluid vacuum cleaning system. The nozzle may comprise a hollow rigid wand, a suction chamber, and at least one aperture located on the rear plate of the suction chamber.

More preferably, the nozzle comprises a hollow, rigid wand having one end adapted for attachment to a vacuum hose pipe of a vacuum cleaner. A rear plate is attached to the other end of the wand which defines an opening where the wand and plate attach. The rear plate extends from the wand at an angle to the wand's longitudinal axis. A front plate is spaced from the rear plate a predetermined distance and is connected to the rear plate by a pair of opposing side plates and a top plate. The plates form a suction chamber having an open end for contact with a surface to be cleaned. The rear plate defines at least one aperture adjacent to its bottom edge and spaced from the edge a predetermined distance for drawing in excess fluid from the surface being cleaned.

The foregoing preferred nozzle can include a cleaning fluid dispenser head disposed on the wand for dispensing cleaning fluid on the surface to be cleaned adjacent to the rear plate. The nozzle can also have side plates that extend rearwardly from the rear plate and form a trap for entrapping excess fluid and for expediting the suction of the fluid.

Preferably, the nozzle includes a pair of apertures located on the rear plate of the suction chamber. The apertures are spaced from the bottom edge of the rear plate and are positioned adjacent to each of the opposing side plates. The cross-sectional areas of the aperture are substantially less than the cross-sectional area of the wand where the wand attaches to the rear plate.

Another present exemplary embodiment concerns a fluid vacuum cleaner for cleaning the surfaces of upholstery, carpets and the like with a cleaning fluid comprising a means for creating and maintaining a vacuum in a vacuum chamber. A vacuum hose pipe is connected to the vacuum chamber on one end and to a rigid, hollow wand on the other end. A rear plate is attached to the other end of the wand which again defines an opening where the wand and plate intersect. The plate extends in an angular direction from the wand. A front plate is spaced from the rear plate a predetermined distance and is connected to the rear plate by a pair of opposing side plates and a top plate. The combination of plates form a suction chamber having an open end for contact with a surface to be cleaned. A cleaning fluid dispenser is supported on the wand for dispensing cleaning fluid adjacent to the rear plate. At least one aperture and preferably two are defined by the rear plate, adjacent to a bottom edge of the rear plate. The apertures are preferably spaced from the edge a predetermined distance and are positioned adjacent the side plates. The apertures draw in excess fluid from the surface being cleaned.

Those of ordinary skill in the art will better appreciate the features and aspects of such embodiment, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which:

FIG. 3 is a side elevation with cut-away portions of a prior art vacuum cleaning nozzle;

FIG. 4 is a sectional elevation taken along sectional line 4—4 of FIG. 3;

Figure 1:
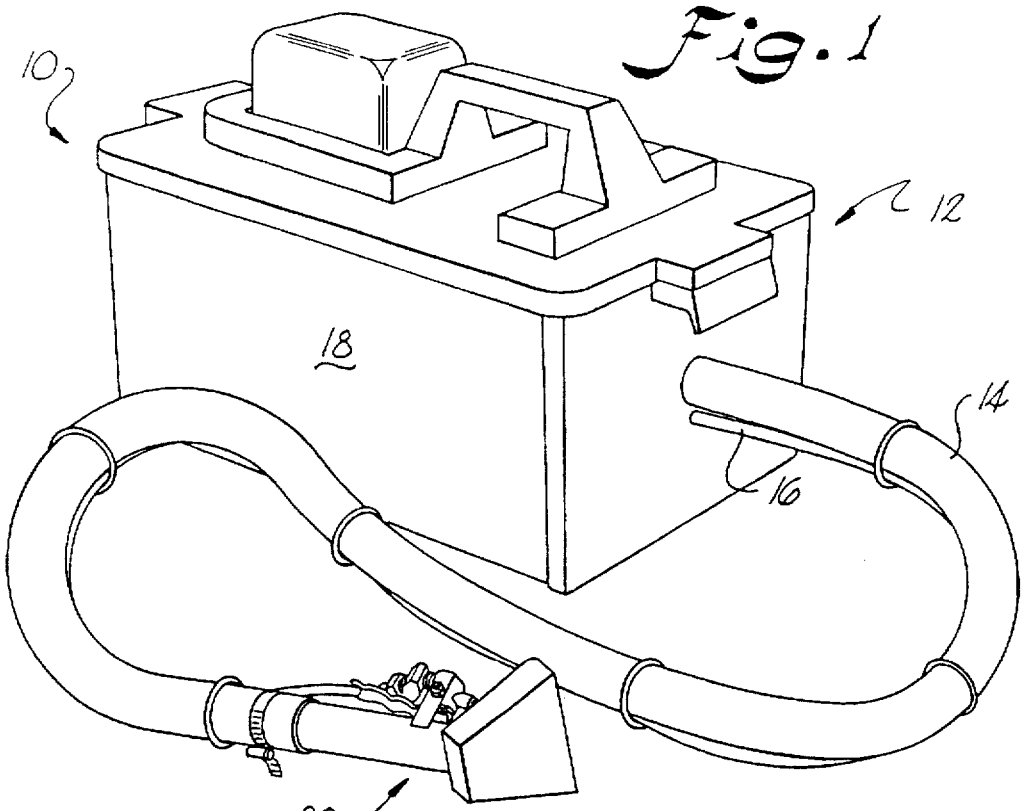
FIG. 1 is a perspective view of a fluid vacuum cleaning system made in accordance with the present invention.

Repeat use of reference characters throughout the present specification and appended drawings is intended to represent same or analogous features or elements of the invention.

DETAILED DESCRIPTION OF THE PREFERRED EMBODIMENTS

Reference will now be made in detail to the presently preferred embodiments of the invention, a complete example of which is fully illustrated in the accompanying drawings. The drawings and accompanying discussion are provided by way of an explanation of the invention, not limitation of the invention. In fact, it will be apparent to those skilled in the art that various modifications and variations can be made in the present invention. For instance, features illustrated or described as part of one embodiment can be used on another embodiment to yield a still further embodiment. Additionally, certain features may be interchanged with similar devices or features not mentioned yet which perform the same or similar function. For example, the hand-held nozzle illustrated might be incorporated into a stand-up embodiment with accompanying wheels. Thus, it is intended that the present invention cover such modifications and variations as come within the scope of the appended claims and their equivalents.

As shown in FIG. 1, an exemplary fluid vacuum cleaning system generally 10 for use in cleaning carpeting, fabric, furniture upholstery or the like is illustrated. Fluid vacuum cleaning system 10 includes a vacuum and fluid dispensing apparatus generally 12 which has a vacuum hose pipe 14 and a fluid dispensing line 16 which terminate at a nozzle generally 20. Apparatus 12 dispenses cleaning fluid out line 16 while maintaining a vacuum in a vacuum chamber 18. The vacuum creates a suction force in vacuum hose pipe 14. Nozzle 20 applies the cleaning fluid and suction force to a surface to be cleaned.

Figure 5:
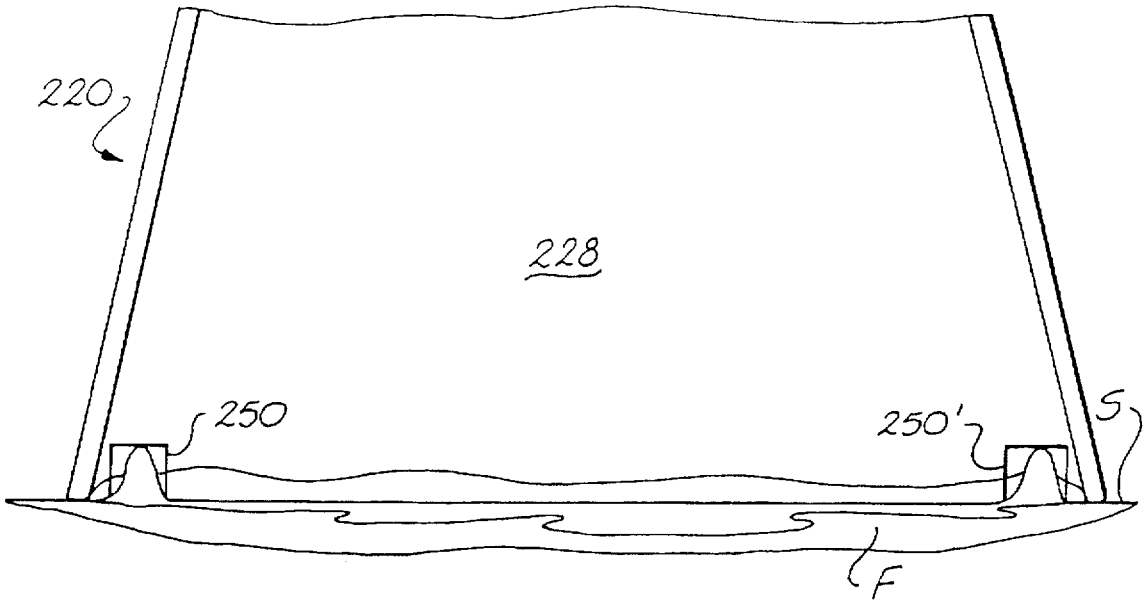
PRIOR ART Fig. 5
FIG. 5 is a rear elevation of a second prior art device.

As discussed in the summary of the invention, the present invention is particularly concerned with improvements in nozzle 20 and other nozzles for fluid vacuum cleaning systems. Prior art nozzles are illustrated in FIGS. 3, 4 and 5. More specifically, FIG. 3 illustrates a nozzle for a fluid vacuum cleaning system generally 120. Nozzle 120 includes a rigid, hollow wand 122 which is attached to a suction chamber generally 124. Suction chamber 124 is formed by a front plate 126 and a rear plate 128. As shown in FIG. 4, front plate 126 and rear plate 128 are typically trapezoidal in shape. Plates 126 and 128 are connected by a top plate 130 and a pair of opposing side plates 132 and 132'. Consequently, suction chamber 124 is enclosed except for an open free end bordered by the bottom edges of front plate 126, rear plate 128 and side plates 132 and 132'. Front plate 126 and rear plate 128 angle towards each other at their bottom edges forming a narrow slit at the open end of suction chamber 124. A suction force created by a vacuum motor (not shown) extends through wand 122 and concentrates along this narrow slit. During operation, the bottom edges of front plate 126 and rear plate 128 form a seal on surface S for removal of moisture and dirt from the material being cleaned. As used here, dirt refers to grease, stains, soil or any other foreign particles found in the material.

Nozzle 120 also includes a cleaning fluid dispenser head generally 134 which is supported on wand 122 by a support bracket 136. Cleaning fluid dispenser head 134 is connected to a fluid dispensing line 116 and includes a hand lever 138 which, when pulled towards wand 122, causes cleaning fluid to dispense out a spray vent 140. The cleaning fluid is sprayed onto surface S behind suction chamber 24 and adjacent to rear plate 128.

As shown in FIG. 3, because a seal forms between suction chamber 124 and surface S, excess fluid F is not removed by nozzle 120 and instead is accumulated behind rear plate 128. In this prior art device, no provision is made for drawing off excess cleaning fluid F other than by raising nozzle 120 and breaking the seal between surface S and the bottom edges of plates 126 and 128 as is illustrated in FIG. 4. However, when nozzle 120 is lifted the material being cleaned can get drawn into suction chamber 124. Also, the cleaning process can take longer and can lead to sporadic and non-uniform cleaning.

Still another prior art device is illustrated in FIG. 5. A nozzle for a fluid vacuum cleaning system generally 220 is shown which is similar to nozzle 120 in FIGS. 3 and 4. However, nozzle 220 includes a pair of notches 250 and 250' for drawing in excess fluid F. Unfortunately, the material being cleaned can get drawn into the notches causing creases or marks in the material as illustrated in the figure.

Figure 2:
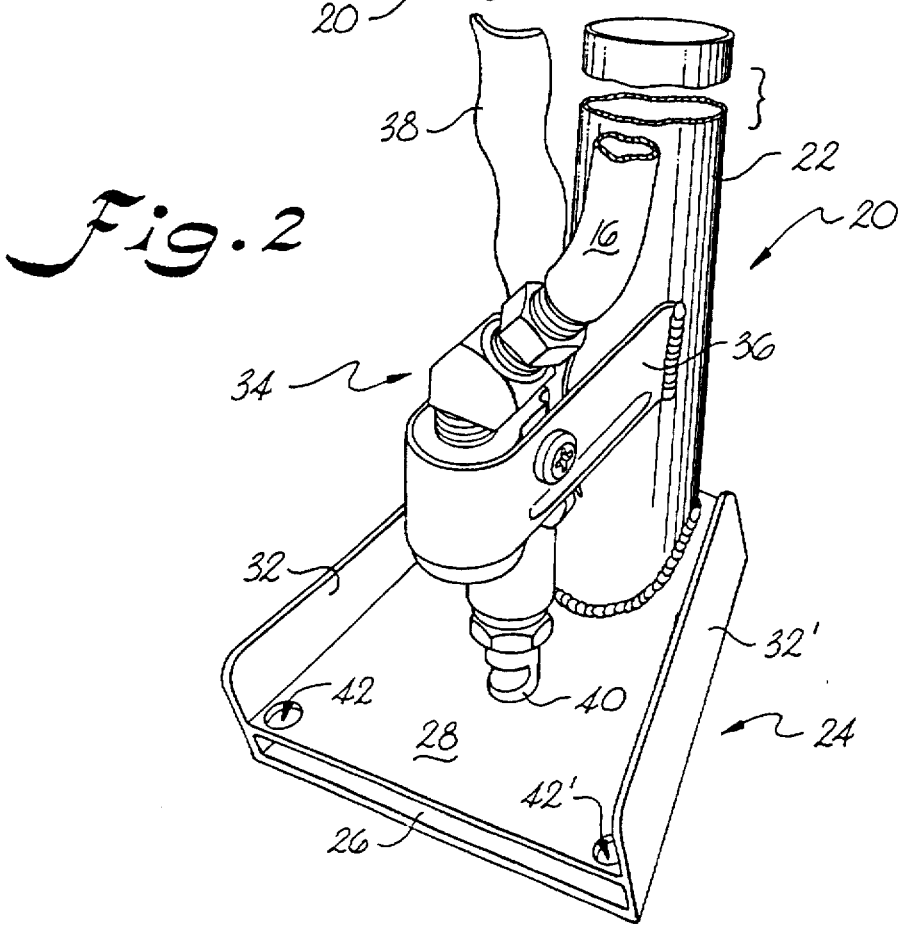
FIG. 2 is a perspective view of one preferred embodiment of the present invention.
Figure 6:
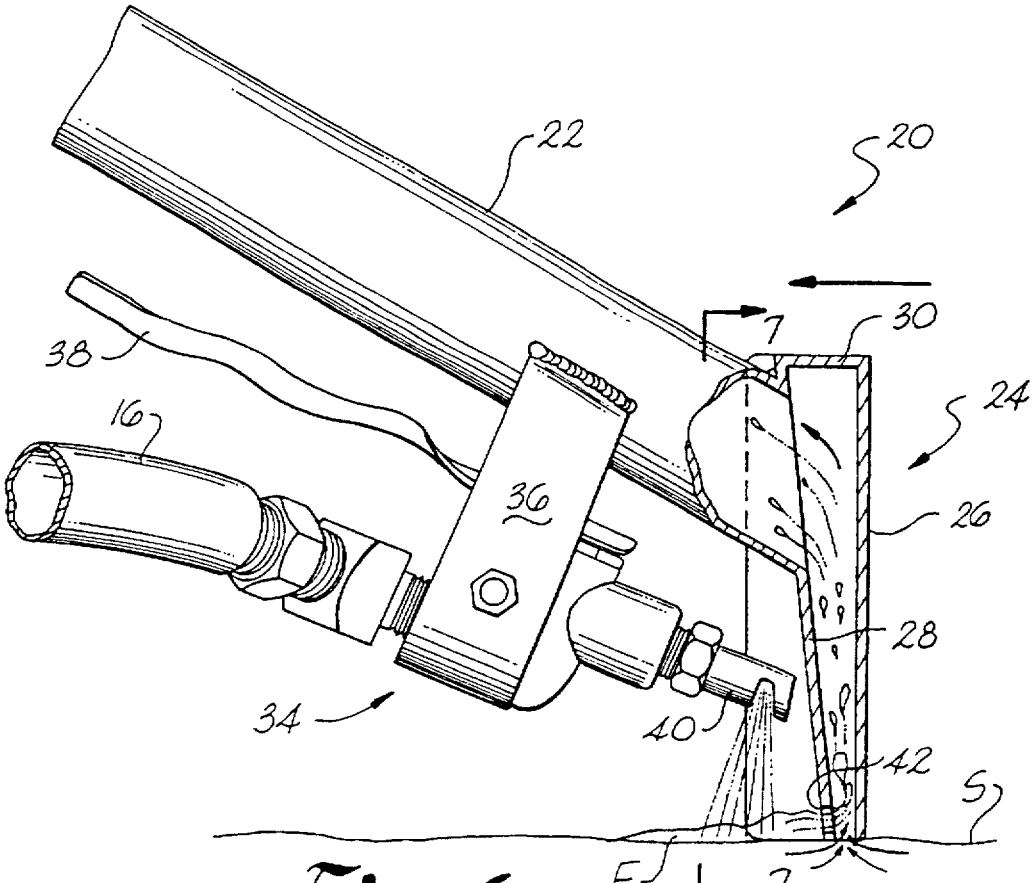
FIG. 6 is a side elevation with cut-away portions of the embodiment of the present invention as shown in FIG. 2.
Figure 7:
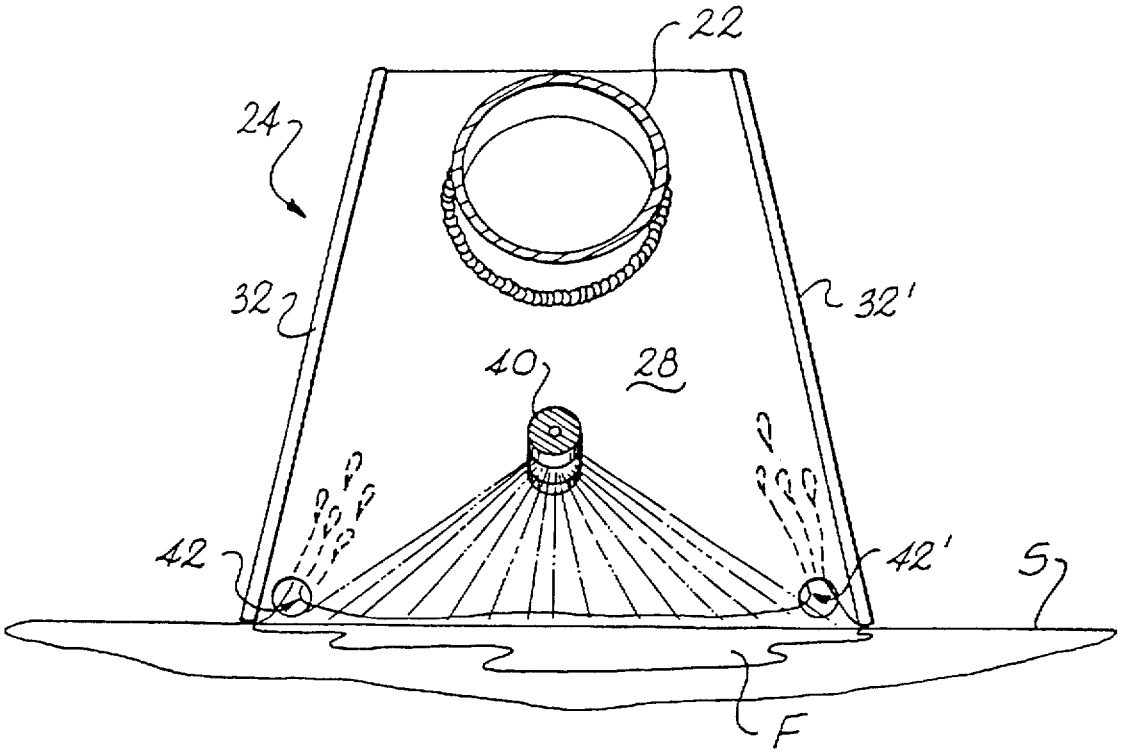
FIG. 7 is a rear sectional elevation taken along sectional line 7—7 of FIG. 6.

A preferred embodiment of the present invention is illustrated in detail in FIGS. 2, 6 and 7. Referring to FIG. 2, a nozzle for a fluid vacuum cleaning system generally 20 includes a rigid, hollow wand 22 attached to a suction chamber generally 24. As shown in FIG. 2, wand 22 is welded to suction chamber 24. However, any similar means of attachment that will fixably connect the two pieces together is within the scope of the present invention. The angle of attachment between wand 22 and suction chamber 24 in this embodiment is slightly greater than 90°. However, the angle of attachment can also be varied depending upon the particular application of nozzle 20 and the contours of the surface to be cleaned. The angle of attachment illustrated in FIGS. 2, 6 and 7 is preferred when using nozzle 20 on a flat surface.

Suction chamber 24 includes a front plate 26 spaced in close proximity to a rear plate 28. Front plate 26 and rear plate 28 are trapezoidal in shape as illustrated in the figures. Plates 26 and 28 are connected and partially enclosed by a top plate 30 and a pair of opposing side plates 32 and 32'. A passageway having approximately the same diameter as wand 22 exists between wand 22 and suction chamber 24. Suction chamber 24 further includes an open end in the shape of a narrow slit bordered by the bottom edges of plates 26, 28, 32 and 32'. A suction force created by a vacuum motor is maintained within wand 22 and becomes concentrated along the narrow slit of suction chamber 24. The open end of suction chamber 24 is applied to various surfaces for removal of moisture and dirt.

Nozzle 20 as shown in FIG. 2 also includes a cleaning fluid dispenser head generally 34 which is supported on wand 22 by support bracket 36. Support bracket 36 in this embodiment is welded to wand 22. However, cleaning fluid dispenser head 34 can be attached to wand 22 by straps, bolts or any other similar means.

Cleaning fluid dispenser head 34 is connected to a fluid dispensing line 16 and includes a hand lever 38 for dispensing fluid out a spray vent 40. Fluid is discharged out spray vent 40 onto a surface S to be cleaned, behind rear plate 28 of suction chamber 24. As shown in FIG. 2, nozzle 20 further includes apertures 42 and 42' located on rear plate 28. In the embodiment shown, the apertures are circular and are positioned close to the bottom edge of rear plate 28 and adjacent opposing side plates 32 and 32'. Apertures 42 and 42' draw off excess fluid F from a surface S without disturbing the contact between suction chamber 24 and surface S and without creasing or marking the material being cleaned. Further, apertures 42 and 42' contribute to a more uniform cleaning when using nozzle 20.

FIGS. 6 and 7 better illustrate the effect apertures 42 and 4' have on nozzle 20. As shown in the figures, excess fluid F is drawn into apertures 42 and 42'. During the evacuation of excess fluid F, contact between suction chamber 24 and surface S is never disrupted. As such, nozzle 20 provides for a more thorough and uniform cleaning of the material when compared to the prior art devices. Further, notches 42 and 42' are positioned so that the material being cleaned is not drawn into suction chamber 24.

Preferably twin apertures are positioned on rear plate 28 next to the bottom edge and adjacent to side plates 32 and 32'. However, less or more apertures can be placed on rear plate 28 in a variety of different positions. In order to remove thin films of excess fluid, the apertures must be placed close to the bottom edge of rear plate 28. The size and shape of the apertures can vary also. Preferably, the apertures are circular and have a cross-sectional area that is substantially less than the cross-sectional area of wand 22. Other shapes of apertures could include ovals, slots or the like. The cross-sectional area of the apertures can be increased or decreased from the embodiment shown in the figures. The exact sizes of the apertures will be selected so as to permit excess fluid to be drawn off without disturbing the cleaning effect of nozzle 20 on surface S. Areas of the apertures will depend upon the horsepower of the vacuum motor, the application of nozzle 20 or the viscosity of the fluid being removed. One exemplary embodiment may include more apertures with smaller diameters.

The preferred embodiment illustrated in FIG. 2 also includes two opposing side plates 32 and 32' that extend rearwardly from rear plate 28 forming a U-shaped barrier behind suction chamber 24. This U-shaped area forms a trap for entrapping excess fluid and accumulating it behind nozzle 20. As nozzle 20 is drawn across surface S in a rearward motion, the trap formed by side plates 32 and 32' aggregates any excess fluid F. The fluid then flows into apertures 42 and 42' and is thereby removed from surface S.

In general, nozzle 20 can be made from a variety of different materials including stainless steel, plastics, ceramics and the like. Also the particular dimensions of nozzle 20 can vary depending upon the application and the horsepower of the vacuum motor. For instance, small spaces to be cleaned or smaller horsepowers may require a smaller nozzle. Further, nozzle 20 can be a hand-held embodiment as shown in the figures or can be incorporated into an upright model. Wheels can also be added onto nozzle 20 in order to assist in movement.

While particular embodiments of the invention have been described and shown, it will be understood by those of ordinary skill in the art that the present invention is not limited thereto since many modifications may be made, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A nozzle for a fluid vacuum cleaning system, comprising:

a hollow, rigid wand having one end adapted for attachment to a vacuum hose pipe of a vacuum cleaner;

a rear plate defining an opening for receiving an opposite end of said wand, said rear plate extending from said wand at an angle to the longitudinal axis of said wand;

a front plate spaced from said rear plate a predetermined distance and connected to said rear plate by a pair of opposing side plates and a top plate, said plates forming a suction chamber having an open end for contact with a surface to be cleaned; and at least one aperture defined by said rear plate, adjacent to a bottom edge of said rear plate, and spaced from said edge a predetermined distance for drawing in fluid from said surface being cleaned.

2. The nozzle as defined in claim 1, wherein portions of said side plates extend rearwardly from said rear plate, forming a trap for entrapping fluid and for expediting the suction of said fluid.

3. The nozzle as defined in claim 1, wherein said rear and front plates extend from said longitudinal axis of said wand at different angles.

4. The nozzle as defined in claim 1, further comprising a cleaning fluid dispenser head disposed on said wand for dispensing cleaning fluid on said surface to be cleaned adjacent said rear plate.

5. The nozzle as defined in claim 4, wherein said cleaning fluid dispenser dispenses said fluid uniformly over an area of said surface substantially equal to the width of said rear plate.

6. The nozzle as defined in claim 1, wherein there are two spaced apertures defined by said rear plate.

7. The nozzle as defined in claim 6, wherein one of said spaced apertures is positioned adjacent one of said side plates.

8. The nozzle as defined in claim 7, wherein both of said spaced apertures are positioned adjacent to each of said opposing side plates.

9. The nozzle as defined in claim 6, wherein the cross-sectional area of said spaced apertures are substantially less than the cross-sectional area of said wand where said wand attaches to said rear plate.

10. A nozzle for a fluid vacuum cleaning system, comprising:

a hollow, rigid wand having one end adapted for attachment to a vacuum hose pipe of a vacuum cleaner;

a rear plate angularly attached to an opposite end of said wand defining an opening for receiving said wand;

a front plate spaced from said rear plate a predetermined distance and connected to said rear plate by a pair of opposing side plates and a top plate;

a suction chamber formed by said rear plate, said front plate, said top plate and said opposing side plates and having an open end for contact with a surface to be cleaned;

a cleaning fluid dispenser head supported on said wand for dispensing cleaning fluid on said surface to be cleaned adjacent to said rear plate; and at least one aperture defined by said rear plate, adjacent to a bottom edge of said rear plate, and spaced from said edge a predetermined distance for drawing in fluid from said surface being cleaned.

11. The nozzle as defined in claim 10, wherein portions of said side plates extend rearwardly from said rear plate, forming a trap for entrapping fluid and for expediting the suction of said fluid.

12. The nozzle as defined in claim 10, wherein said rear and front plates extend from said longitudinal axis of said wand at different angles.

13. The nozzle as defined in claim 10, wherein said cleaning fluid dispenser dispenses said fluid uniformly over an area of said surface substantially equal to the width of said rear plate.

14. The nozzle as defined in claim 10, wherein there are two spaced apertures defined by said rear plate.

15. The nozzle as defined in claim 14, wherein one of said spaced apertures is positioned adjacent to one of said side plates.

16. The nozzle as defined in claim 15, wherein both of said spaced apertures are positioned adjacent to each of said opposing side plates.

17. The nozzle as defined in claim 14, wherein the cross-sectional areas of said spaced apertures are substantially less than the cross-sectional area of said wand where said wand attaches to said rear plate.

18. A fluid vacuum cleaner for cleaning the surfaces of upholstery, carpets, and the like with a cleaning fluid, comprising:

means for creating and maintaining a vacuum in a vacuum chamber;

a vacuum hose pipe connected to said vacuum chamber at one end and to a rigid, hollow wand at an opposite end;

a rear plate attached to said wand, defining an opening for receiving said wand, said rear plate extending from said wand at an angle to the longitudinal axis of said wand;

a front plate spaced from said rear plate a predetermined distance and connected to said rear plate by a pair of opposing side plates and a top plate, said plates forming a suction chamber having an open end for contact with a surface to be cleaned;

a cleaning fluid dispenser head supported on said wand for dispensing cleaning fluid on said surface to be cleaned adjacent to said rear plate; and at least one aperture defined by said rear plate, adjacent to a bottom edge of said rear plate, and spaced from said edge a predetermined distance for drawing in fluid from said surface being cleaned.

19. The fluid vacuum cleaner as defined in claim 18, wherein portions of said side plates extend rearwardly from said rear plate, forming a trap for entrapping fluid and for expediting the suction of said fluid.

20. The fluid vacuum cleaner as defined in claim 18, wherein said rear and front plates extend from said longitudinal axis of said wand at different angles.

21. The fluid vacuum cleaner as defined in claim 18, wherein said cleaning fluid dispenser dispenses said fluid uniformly over an area of said surface substantially equal to the width of said rear plate.

22. The fluid vacuum cleaner as defined in claim 18 wherein there are two spaced apertures defined by said rear plate.

23. The fluid vacuum cleaner as defined in claim 22, wherein one of said spaced apertures is positioned adjacent to one of said side plates.

24. The fluid vacuum cleaner as defined in claim 23, wherein both of said spaced apertures are positioned adjacent to each of said opposing side plates.

25. The fluid vacuum cleaner as defined in claim 22, wherein the cross-sectional areas of said spaced apertures are substantially less than the cross-sectional area of said wand where said wand attaches to said rear plate.

* * * * *